US006257176B1

(12) United States Patent
Shimasaki et al.

(10) Patent No.: US 6,257,176 B1
(45) Date of Patent: Jul. 10, 2001

(54) VARIABLE CYCLE INTERNAL COMBUSTION ENGINE AND CONTROLLER THEREOF

(75) Inventors: Yuichi Shimasaki; Eitetsu Akiyama; Kenji Abe; Shunichi Tsuzuki, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/451,757

(22) Filed: Dec. 1, 1999

(30) Foreign Application Priority Data

Dec. 8, 1998 (JP) ..... 10-348911

(51) Int. Cl.[7] ..... F02B 69/06
(52) U.S. Cl. ..... 123/21
(58) Field of Search ..... 123/21, 90.16

(56) References Cited

U.S. PATENT DOCUMENTS 4,612,884 * 9/1986 Ajiki et al. ..... 123/90.16
5,036,801 * 8/1991 Imajou ..... 123/21

FOREIGN PATENT DOCUMENTS 58-152139 * 9/1983 (JP) .
64-63617 3/1989 (JP) .
7-238840 9/1995 (JP) .

* cited by examiner

*Primary Examiner*—Willis R. Wolfe
*Assistant Examiner*—Hyder Ali
(74) *Attorney, Agent, or Firm*—Arent Fox Kintner Plotkin & Kahn

(57) ABSTRACT

A two-cycle action cam having two protruding parts 1*a* and 1*b* and a four-cycle action cam 3 having one protruding part 3*a* are selectively used by a cam change mechanism 46*i*. The two-cycle action cam 1 effects opening of the inlet and exhaust valves once per revolution of the crankshaft and the four-cycle action cam 3 effects opening of the inlet and exhaust valves once per two revolutions of the crankshaft. The four-cycle action is selected when the engine is in the low revolving speed and running at a low load and the two-cycle action is otherwise selected.

9 Claims, 6 Drawing Sheets

VARIABLE CYCLE INTERNAL COMBUSTION ENGINE AND CONTROLLER THEREOF

BACKGROUND OF THE INVENTION

1. Field of the Invention

The present invention relates to an internal combustion engine having a variable engine cycle, and a controller thereof.

2. Description of the Related Art

A variable cycle internal combustion engine having a structure that allows a 2-cycle internal combustion engine to run also at four cycles or six cycles has been proposed in Japanese Patent Unexamined Publication No. Heisei 7-238840(1995).

The above-mentioned publication discloses the following features: 1) running at different engine cycles, and inlet and exhaust valves consisting of a solenoid valve; 2) both a camshaft for four cycles and a camshaft for six cycles so that a rocker arm is driven by either of the camshafts in accordance with a displacement of the center axis of a locker hinge; 3) running either at four cycles or at six cycles by selection of the camshaft revolving speed; and 4) running at two cycles by opening and closing inlet and exhaust ports and a scavenging air port for the two-cycle action instead of using the inlet and exhaust valves, meanwhile when running at four cycles, the inlet and exhaust ports are opened and closed by inlet and exhaust valves disposed at an upper part of the combustion chamber.

The above-described solenoid-driven inlet and exhaust valves of feature 1) have technical problems. The mechanisms of features 2) and 3) have complicated structures for changing actions and thus result in decreased reliability and increased costs. As for the mechanism of feature 4), since in the case of the four-cycle action the inlet and exhaust ports and the scavenging air port for the two-cycle action remain as they are, whether or not the four-cycle action proceeds normally is not known; the disclosure with respect to feature 4) is insufficient.

The above-mentioned Japanese publication describes some means for realizing a variable cycle engine, but does not specifically disclose how to select the cycles or a control method.

SUMMARY OF THE INVENTION

Considering the above-described problems, it is an object of the present invention to provide a highly reliable variable cycle engine with a comparatively simple structure. It is another object of the present invention to provide a controller for adequate selection of the cycles in a variable cycle engine such as the one described above.

To meet the above first object, according to the first aspect of the invention, there is provided a variable cycle internal combustion engine, including: a first cam driving an inlet valve and an exhaust valve, the first cam having at least one first projection; a second cam driving the inlet valve and exhaust valve, the second cam having at least one second projection, the number of which is different from that of the first projection; and a cam change mechanism for changeover between the first and second cams, so that the engine is operable at different engine cycles.

With this structure, the first cam and the second cam having a different number of projections are selectively used by the cam change mechanism and, for example, two-cycle action is carried out when the first cam is selected while four-cycle action is carried out when the second cam is selected. Existing mass-produced parts may be used as a cam change mechanism for selection between a high-speed valve timing cam, which is appropriate for the high revolving speed range of the engine, and a low-speed valve timing cam, which is appropriate for the low revolving speed range. Therefore, a highly reliable variable cycle internal combustion engine can be realized using a relatively simple structure.

Further, according to the second aspect of the invention, there is provided a controller of a variable cycle internal combustion engine, the engine including: a first cam driving an inlet valve and an exhaust valve, the first cam having at least one first projection; a second cam driving the inlet valve and exhaust valve, the second cam having at least one second projection, the number of which is different from that of the first projection; and a cam change mechanism for changeover between the first and second cams, so that the engine is operable at different engine cycles, the controller including: an engine running state detection unit detecting engine load and engine revolving speed; and a control unit for selecting an engine cycle based on the detected engine load and engine revolving speed and controlling the cam change mechanism so as to operate at the selected engine cycle.

With this structure, the cam change mechanism is controlled to operate at the engine cycle that is selected according to the detected engine load and engine revolving speed. Thus, it is possible to improve the engine output (volumetric efficiency) at the medium and high revolving speed of the engine by running the engine at the engine cycle appropriate to the engine running state without causing problems, such as unstable combustion.

The entire disclosure of each and every foreign patent application from which the benefit of foreign priority has been claimed in the present application is incorporated herein by reference, as if fully set forth.

DETAILED DESCRIPTION OF THE PREFERRED EMBODIMENTS

With reference to the drawings, embodiments of the present invention are described below.

(First Embodiment)

Figure 1:
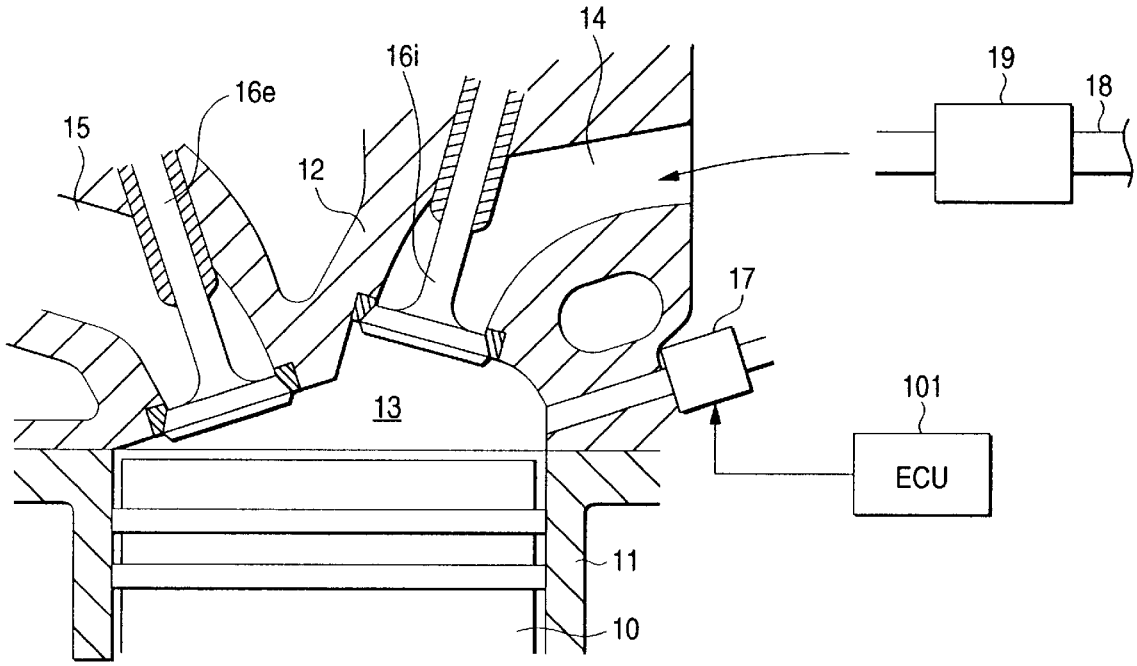
FIG. 1 shows a structure of an internal combustion engine related to an embodiment of the present invention.

FIG. 1 shows a structure of the variable cycle internal combustion engine (hereinafter referred to as "engine") related to an embodiment of the present invention. A cylinder head 12 combined with the upper side of a cylinder block 11 constitutes the engine main body and, the cylinder block 11, the cylinder head 12 and a piston 10 form a combustion chamber 13. A pair of inlet valves **16*i* is provided at an inlet port 14 and a pair of exhaust valves 16***e* is provided at an exhaust port 15. The inlet port 14 communicates with an inlet air path 18, and a supercharger 19 is provided on the inlet air path 18. A fuel injection valve 17 for direct fuel injection into the combustion chamber 13 is also provided. The fuel injection valve 17 is connected to an electronic control unit 101 (hereinafter referred to as "ECU"), which controls the valve opening duration and time. Every cylinder is provided with an ignition plug (not shown) and the ECU 101 controls the ignition timing.

A two-cycle engine with a supercharger as shown in FIG. 1 is disclosed, for example, in Japanese Patent Unexamined Publication Heisei 1-63617 (1989). This two-cycle action is enabled by respectively opening the inlet valves 16*i* and exhaust valves 16*e* when the piston 10 is in the vicinity of bottom dead center (BDC), as shown in solid lines in and dashed lines in FIG. 4B, and by feeding air pressurized by the supercharger 19 to the combustion chamber 13. The fuel injection by the fuel injection valve 17 is carried out while the inlet valve 16*i* is open.

Figure 2:
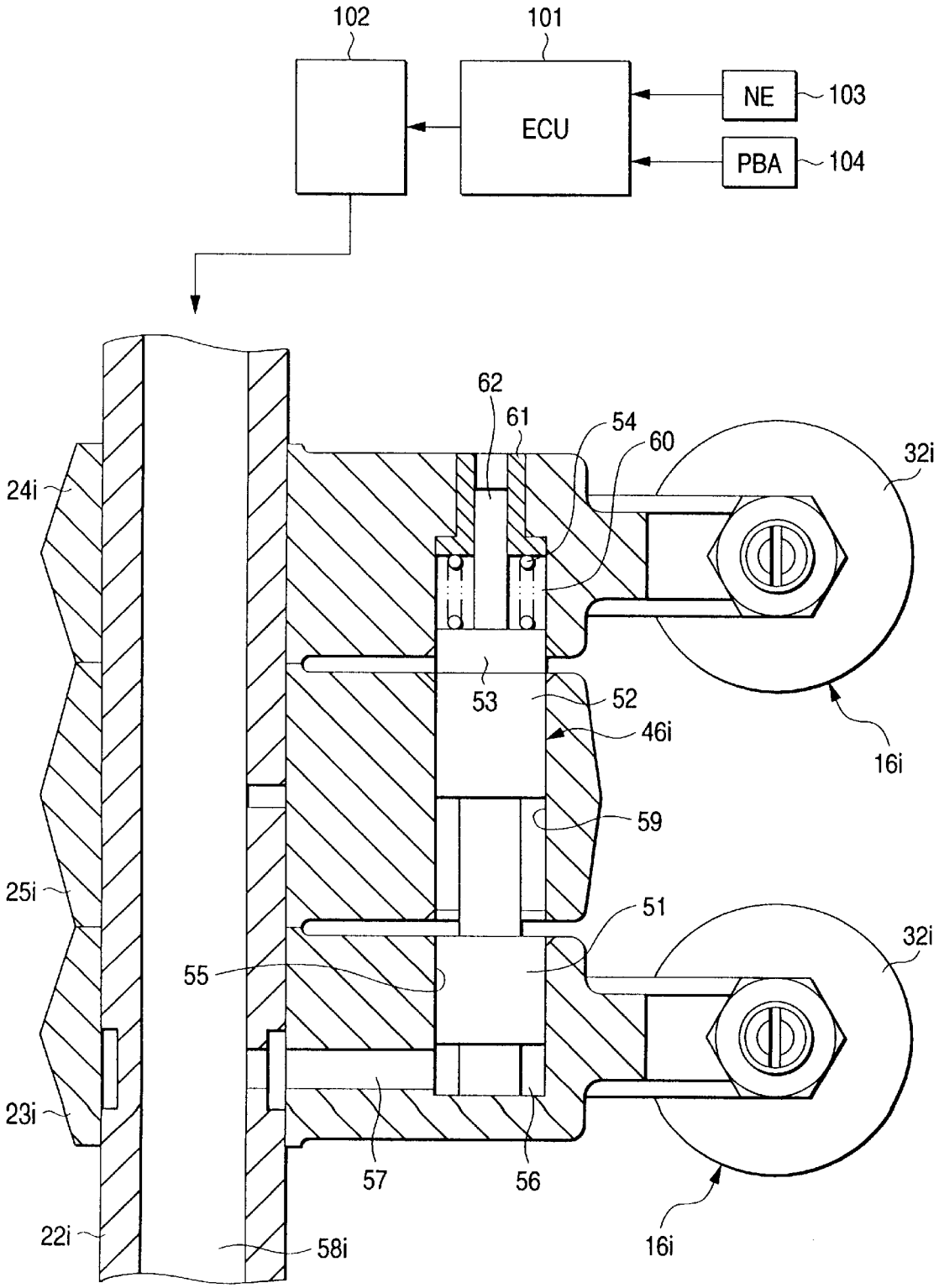
FIG. 2 shows a cam change mechanism and a controller of the engine of FIG. 1.

The engine of this embodiment is a four-cylinder engine where each of the cylinders is provided with a pair of inlet valves 16*i* and a pair of exhaust valves 16*e*. The inlet and exhaust valves 16*i* and 16*e* are composed so as to be driven by a valve system that involves a cam change mechanism as shown in FIG. 2. FIG. 2 shows the valve system on the inlet valve side only, but the same structure exists on the exhaust valve side.

Figure 3:
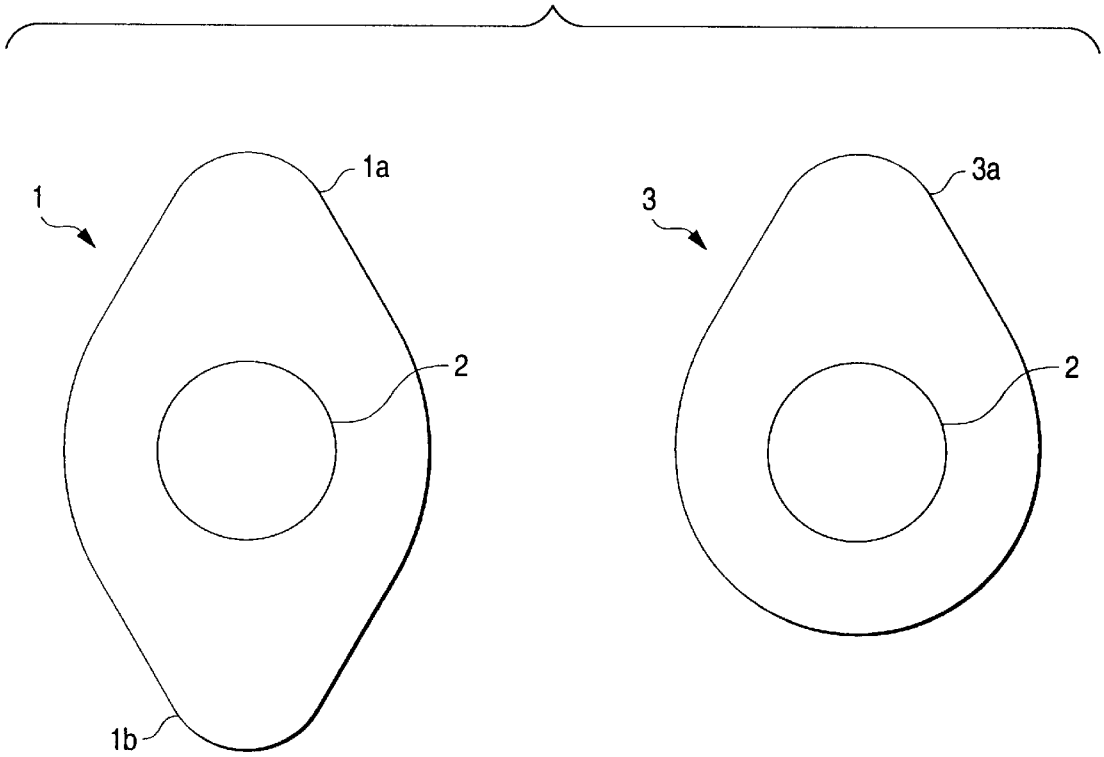
FIG. 3 shows cam profiles of a two-cycle action cam and a four-cycle action cam.

FIG. 3 shows profiles of a two-cycle action cam 1 and a four-cycle action cam 3, each secured on the camshaft 2. The four-cycle action cam 3 has a protruding part 3*a* for opening the inlet valve 16*i* once per revolution of the camshaft. The two-cycle action cam 1 has two protruding parts 1*a* and 1*b* for opening the inlet valve 16*i* twice per revolution of the camshaft. The two protruding parts 1*a* and 1*b* are disposed at intervals of an approximately equal angle in the circumferential direction of the camshaft 2. In this embodiment, two four-cycle action cams 3 are disposed per cylinder, while one two-cycle action cam 1 is disposed per cylinder. The camshaft 2 is configured so as to be driven by a crankshaft (not shown) at a speed reduction ratio of 1/2 via a timing belt.

In FIG. 2, a rocker shaft 22*i* is secured to be parallel to the camshaft 2. A first driving rocker arm 23*i*, a second driving rocker arm 24*i* and a free rocker arm 25*i* are attached to the rocker shaft 22*i* so as to be capable of turning. Each of the rocker arms 23*i*, 24*i* and 25*i* are provided with a cam change mechanism 46*i* which is actuated by hydraulic pressure supplied via an oil supply path 58*i* which is disposed inside the rocker shaft 22*i*. A flange part 32*i* in FIG. 2 is secured to the inlet valve 16*i*, and a spring which applies force in such a direction as to close the inlet valve 16*i* is provided between the flange part 32*i* and the cylinder head 12.

The cam change mechanism 46*i* includes a first changeover pin 51, a second changeover pin 52, a control pin 53 and a return spring 54. The first changeover pin 51 can connect between the first driving rocker arm 23*i* and the free rocker arm 25*i*. The second changeover pin 52 can connect between the free rocker arm 25*i* and the second driving rocker arm 24*i*. The control pin 53 controls the movement of the first and second changeover pins 51 and 52. The return spring 54 applies force to the pins 51 through control pin 53 toward the disconnecting side.

A bottomed first guide hole 55 which opens on the free rocker arm 25*i* side is formed in the first driving rocker arm 23*i* to be parallel to the rocker shaft 22*i*. The first changeover pin 51 is slidably fitted in the first guide hole 55, so that a hydraulic pressure chamber 56 is formed between an end of the first changeover pin 51 and a blocked end of the first guide hole 55. A path 57 which communicates with the hydraulic pressure chamber 56 is formed in the first driving rocker arm 23*i*, and the oil supply path 58*i* normally communicates with the hydraulic pressure chamber 56 via the path 57 regardless of the sliding state of the first driving rocker arm 23*i*.

A guide hole 59, which corresponds with the first guide hole 55, is formed in the free rocker arm 25*i* to be parallel to the rocker shaft 22*i*. The second changeover pin 52, an end of which contacts the other end of the first changeover pin 51 is slidably fitted in the guide hole 59. A bottomed second guide hole 60 which corresponds to the guide hole 59 is formed in the second driving rocker arm 24*i* so as to open on the free rocker arm 25*i* side and so as to be parallel to the rocker shaft 22*i*. A disk-shaped control pin 53 which contacts with the other end of the second changeover pin 52 is slidably fitted in the second guide hole 60. A guide cylinder 61 is fitted in a blocked end of the second guide hole 60 and a shaft part 62 which fits slidably in the guide cylinder 61 is provided so as to be coaxial to and integral with the control pin 53. The return spring 54 is inserted between the guide cylinder 61 and the control pin 53, and the return spring 54 applies force to the pins 51, 52 and 53 towards the hydraulic pressure chamber 56 side.

In the cam change mechanism 46*i* of this structure, when the hydraulic pressure in the hydraulic pressure chamber 56 increases, the first changeover pin 51 fits in the guide hole 59 while the second changeover pin 52 fits in the second guide hole 60 to thereby connect the rocker arms 23*i*, 25*i* and 24*i*. When the hydraulic pressure in the hydraulic pressure chamber 56 decreases, the spring force of the return spring 54 causes the contact face of the first changeover pin 51 with the second changeover pin 52 to be returned to a corresponding position between the first driving rocker arm 23*i* and the free rocker arm 25*i*. Further, the contact face of the second changeover pin 52 with the control pin 53 is returned to a corresponding position between the free rocker arm 25*i* and the second driving rocker arm 24*i* to thereby disconnect the rocker arms 23*i*, 25*i* and 24*i*.

In this structure, the first and second rocker arms 23*i* and 24*i* contact the four-cycle action cam 3 and the free rocker arm 25*i* contacts the two-cycle action cam 1. Therefore, when the rocker arms 23*i*, 25*i* and 24*i* are connected, the valve opening action for the inlet valve 16*i* is carried out in correspondence with the profile of the two-cycle action cam 1. When the rocker arms 23*i*, 25*i* and 24*i* are disconnected, the valve opening action for the inlet valve 16*i* is carried out in correspondence with the profile of the four-cycle action cam 3. That is, the changeover between the high and low hydraulic pressures in the hydraulic pressure chamber 56 via the oil supply path 58*i* effects selection between the two-cycle action cam 1 and the four-cycle action cam 3.

Figure 4A:
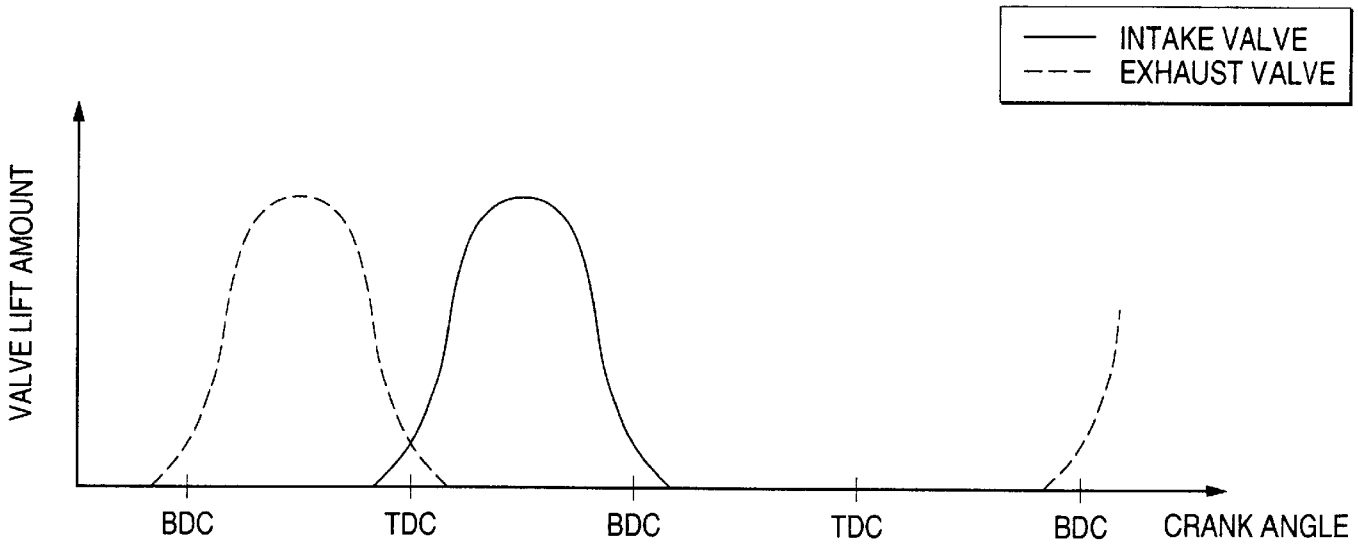
FIGS. 4A and 4B show valve lift characteristics of an inlet valve and an exhaust valve.
Figure 4B:
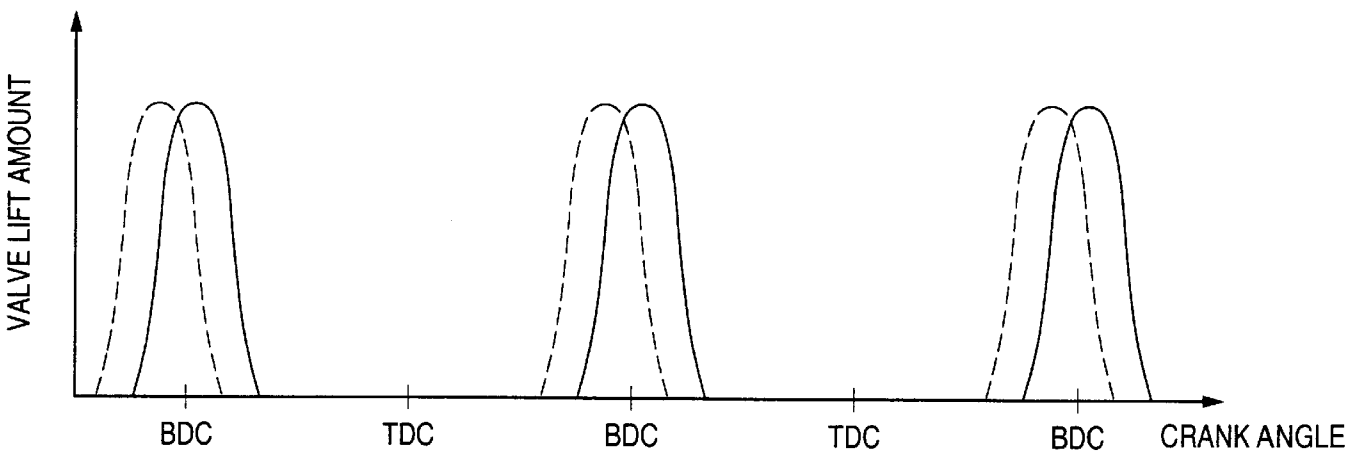

Although the inlet valve 16*i* side has been described above, the valve system for the exhaust valve 16*e* side has a similar structure. Thus, when the four-cycle action cam 3 is selected, the inlet and exhaust valves 16*i* and 16*e* are opened once every two revolutions of the crankshaft, as shown in FIG. 4A. Meanwhile, when the two-cycle action cam 1 is selected, the valves are opened once every revolution of the crankshaft, as shown in FIG. 4B. In FIGS. 4A and 4B, solid lines show lift curves for the inlet valve 16*i* and dashed lines show lift curves for the exhaust valve 16*e*.

The cam change mechanism 46*i* shown in FIG. 2 has been mass-produced as a mechanism for selection between a high-speed valve timing cam which is appropriate for the high revolving speed range of the engine and a low-speed valve timing cam which is appropriate for the low revolving speed range. The cam change mechanism 46*i* is highly reliable and available at low cost. Therefore, this embodiment can provide a highly reliable variable cycle internal combustion engine with a comparatively simple structure.

The hydraulic pressure inside the oil supply path 58*i* is constructed so as to be controlled by a solenoid valve 102 for hydraulic pressure control, and action of the solenoid valve 102 is controlled by the ECU 101. The ECU 101 is connected to an engine revolution sensor 103 for detection of engine revolutions per unit time (engine revolving speed) NE and to an inlet-pipe-internal absolute pressure sensor 104 for detection of an inlet-pipe-internal absolute pressure PBA as a parameter expressing the engine load. The detection signals from these sensors are supplied to the ECU 101. The ECU 101 is also connected to a crank angle sensor (not shown) for detection of the crank angle to be utilized as a datum for control of the fuel injection timing and ignition timing.

The ECU 101 selects either the two-cycle action or the four-cycle action, according to the engine running state as described below, and carries out changeover control of the cam change mechanism 46*i* and selection of the fuel injection timing and the ignition timing in synchronism with the cam change.

During four-cycle action, the gas exchange and combustion are comparatively efficient in the low revolving speed range through the high revolving speed range. However, since only one induction stroke occurs in two engine revolutions, the volumetric efficiency per revolution is reduced by half as compared with the two-cycle action. On the other hand, during two-cycle action, since the process of the combustion and exhaustion and the process of the exhaustion and suction proceed almost simultaneously, exhaust gas and new induction air are mixed in the low revolving speed range where the gas flows slowly. This tends to cause ineffective gas exchange, degradation of the combustion state and abnormal combustion due to increase in the intake air temperature, such as knocking and pre-ignition. During two-cycle action, however, since one air intake process occurs for every revolution, the volumetric efficiency per revolution is high and thus, if the revolving speed is the same, a twice larger output can be obtained in comparison with the four-cycle action. The above-described points are incorporated below into Table 1.

TABLE 1

| Items | Revolving Speed | 4-cycle action | 2-cycle action |
|---|---|---|---|
| Output | Low | ○ | Δ |
| (Volumetric | Medium | ○ | ◎ |
| efficiency) | High | ○ | ◎ |
| Fuel Stability | Low | ○ | Δ |
| (Fuel cost) | Medium | ○ | ○ |
| | High | ○ | ○ |
| Abnormal | Low | ○ | Δ |
| Combustion | Medium | ○ | ○ |
| | High | ○ | ○ |

In Table 1, "◎" indicates excellently high performance and "○" indicates moderate performance while "Δ" indicates low performance.

In Table 1, "◎" indicates excellently high performance and "○" indicates moderate performane which "Δ" indicates low performance.

Figure 5A:
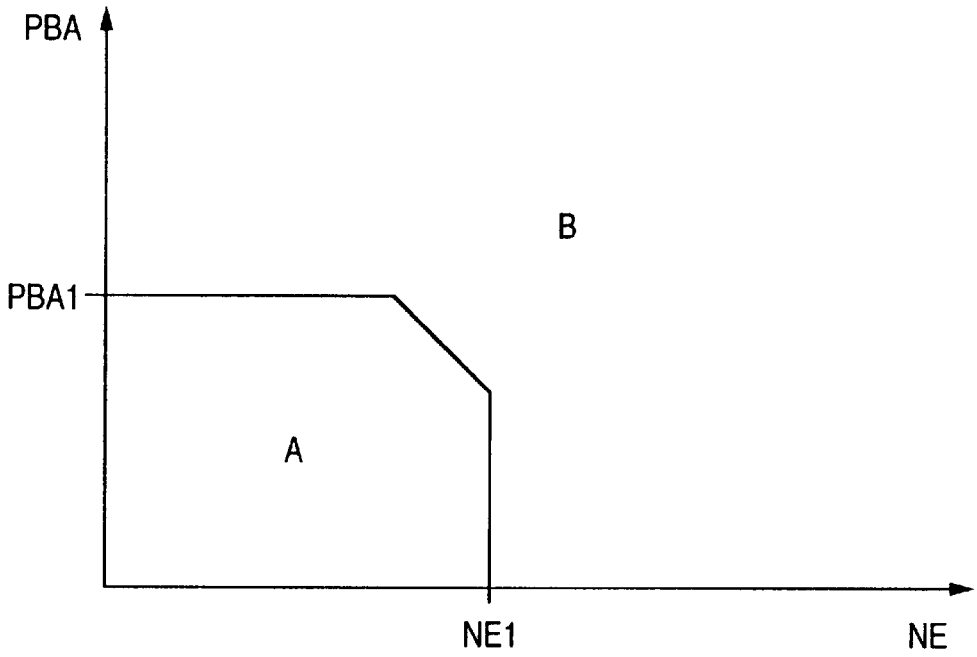
FIGS. 5A and 5B show an engine running area for two-cycle action and an engine running area for four-cycle action.

In view of the advantages and disadvantages of two-cycle action and four-cycle action, in this embodiment, the ECU 101 controls selection of four-cycle action for area A in FIG. 5A, and two-cycle action for area B. That is, the ECU 101 determines whether the engine running state is in area A or B, based on the detected engine revolving speed NE and the inlet-pipe-internal absolute pressure PBA. The ECU 101 controls the solenoid valve 102 so that four-cycle action is selected for area A and two-cycle action is selected for area B while controlling the fuel injection timing and the ignition timing so that they are appropriate for respective actions. A predetermined revolving speed NE1 and a predetermined pressure PBA for separating the areas in FIG. 5A are, for example, 3,000 rpm and 200 mmHg.

This control respectively can utilize the advantages of four-cycle action and two-cycle action and realizes a high volumetric efficiency in the medium and high revolving speed range without incurring any drop in the output or instability of combustion in the low-revolving-speed and low-load range.

In this embodiment, the two-cycle action cam 1 and the four-cycle action cam 3 correspond to the first and second cams and the engine revolving speed sensor 103. The inlet-pipe-internal absolute pressure sensor 104 corresponds to the engine running state detection means. The ECU 101 corresponds to the control means.

(Second Embodiment)

Figure 6:
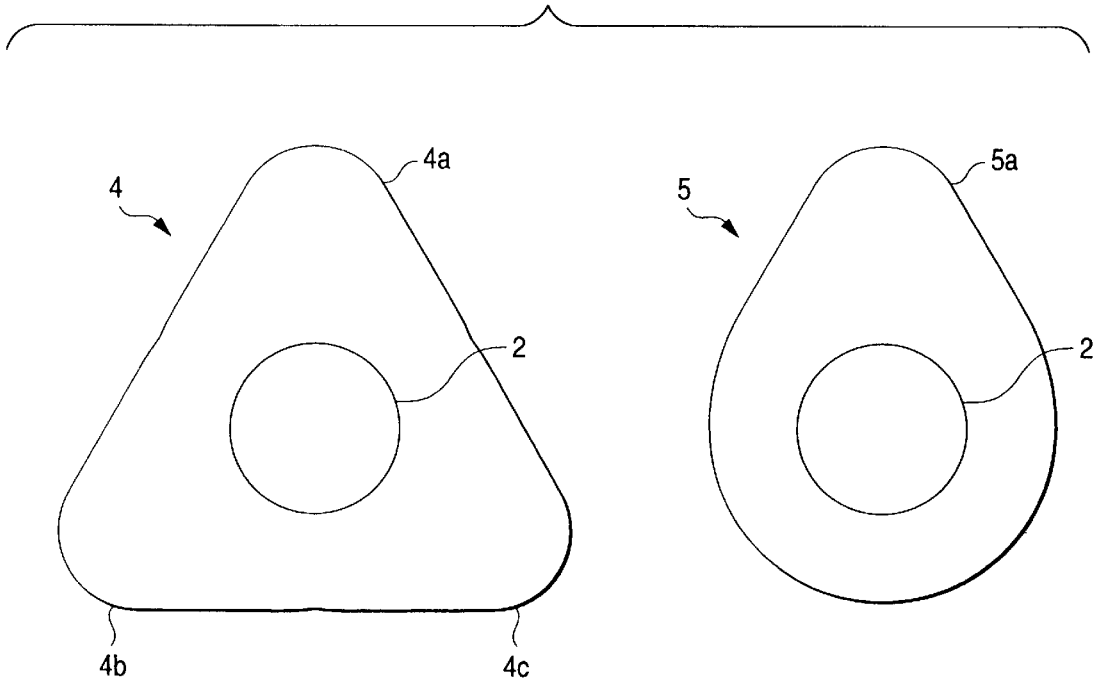
FIG. 6 shows cam profiles of a two-cycle action cam and a six-cycle action cam.

In the second embodiment, a two-cycle action cam 4 and a six-cycle action cam 5 as shown in FIG. 6 are utilized in place of the cams shown in FIG. 3. The camshaft 2 is composed so as to be driven by the crankshaft via a timing belt at a reduction ratio of 1/3. Also, a variable cycle internal combustion engine, which can select between the two cycle action and the six-cycle action, is constituted. In the same way as the four-cycle action cam 3 in FIG. 3, the six-cycle action cam 5 in FIG. 6 has one protruding part 5*a* for opening inlet and exhaust valves once per one revolution of the camshaft and the two-cycle action cam 4 has three protruding parts 4*a*, 4*b* and 4*c* for opening the inlet and exhaust valves three times per one revolution of the camshaft. The three protruding parts 4*a*, 4*b* and 4*c* are disposed at intervals of an approximately equal angle in the circumferential direction of the camshaft 2.

Except for the above-described points, the second embodiment is the same as the first embodiment.

The six-cycle action includes decompressing and compressing processes that are in addition to the four-cycle action. Since the six-cycle action facilitates evaporation of the fuel resulting in a more favorable mixture state of the fuel and the air, favorable combustion is realized.

(Other Embodiments)

Figure 5B:
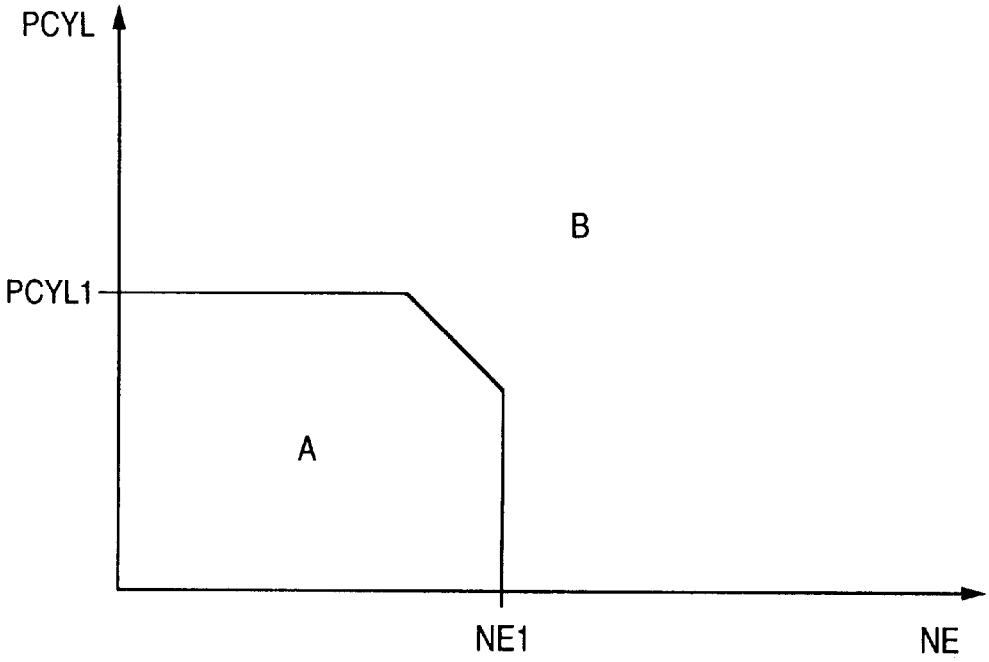

The present invention is not restricted to the above-described embodiments but may have some variations. For example, each of the engine cylinders may be provided with a cylinder-internal pressure sensor and, as shown in FIG. 5B, area A for four-cycle action in accordance with the detected cylinder-internal pressure PCYL and the engine revolving speed NE and area B for two-cycle action may be discerned. In this case, as for the cylinder-internal pressure PCYL, for example, a maximum pressure immediately after ignition is utilized. Since the cylinder-internal pressure PCYL is reflected with the actual state of combustion inside the combustion chamber, appropriate changeover of the actions is available.

As described in detail above, the first cam and the second cam having a different number of projections are selectively used by the cam change mechanism and, for example, two-cycle action is carried out when the first cam is selected while four-cycle action is carried out when the second cam is selected. Since existing mass-produced parts can be utilized for the cam change mechanism, a highly reliable variable cycle internal combustion engine can be realized with a comparatively simple structure.

Moreover, the engine cycle is selected according to the detected engine load and engine revolving speed. As a result, the cam change mechanism is controlled to work at the selected engine cycle. It is therefore possible to improve the engine output (volumetric efficiency) at the medium and high revolving speed of the engine by running the engine at the engine cycle appropriate to the engine running state without causing problems such as unstable combustion.

What is claimed is:

1. A controller of a variable cycle internal combustion engine, said engine comprising:

a first cam driving an inlet valve and an exhaust valve, said first cam having at least one first projection;

a second cam driving the inlet valve and exhaust valve, said second cam having at least one second projection, the number of which is more than that of said first projection; and a cam change mechanism for changeover between said first and second cams, so that said engine is operable at different engine cycles; and a controller comprising:

an engine running state detector detecting engine load and engine revolving speed, said engine running state detector using an inlet-pipe-internal absolute pressure as a parameter representing the engine load; and control means for selecting an engine cycle based on the detected engine load and engine revolving speed and controlling said cam change mechanism so as to operate at the selected engine cycle, wherein said controller selects said first cam, when the engine revolving speed is not more than a predetermined revolving speed and the inlet-pipe-internal absolute pressure is not more than a predetermined pressure.

2. The variable cycle internal combustion engine according to claim 5, wherein said cam change mechanism includes:

a driving rocker arm defining a first guide hole and being contactable with said first cam;

a free rocker arm defining a second guide hole and being contactable with said second cam;

a piston slidably received in said first guide hole, said piston being movable toward said second guide hole by means of hydraulic pressure so as to connect said free rocker arm with said driving rocker arm; and a spring urging said piston toward said first guide hole against the hydraulic pressure, wherein, when said free rocker arm is connected with said driving rocker arm by said piston, said intake valve and exhaust valve are opened in accordance with the profile of said second cam, and when said free rocker arm is disconnected from said driving rocker arm, said intake valve and exhaust valve are opened in accordance with the profile of said first cam.

3. The controller of a variable cycle internal combustion engine according to claim 1, wherein said engine running state detection means uses an inlet-pipe-internal absolute pressure as a parameter representing the engine load.

4. The variable cycle internal combustion engine according to claim 1, wherein said first cam is a two-cycle action cam and said second cam is a four-cycle action cam.

5. The variable cycle internal combustion engine according to claim 1, wherein said first cam is a two-cycle action cam and said second cam is a six-cycle action cam.

6. A controller of a variable cycle internal combustion engine said engine comprising:

a first cam driving an inlet valve and exhaust valve, said first cam having at least one first projection;

a second cam driving the inlet valve and exhaust valve, said second cam having at least one second projection, the number of which is more than that of said first projection; and a cam change mechanism for changeover between said first and second cams, so that said engine is operable at different engine cycles; and a controller comprising:

an engine running state detector detecting engine load and engine revolving speed, said engine running state detector using a cylinder-internal pressure of the engine as a parameter representing the engine load; and control means for selecting an engine cycle based on the detected engine load and engine revolving speed and controlling said cam change mechanism so as to operate at the selected engine cycle, wherein said controller selects said first cam, when the engine revolving speed is not more than a predetermined revolving speed and the cylinder-internal pressure is not more than a predetermined pressure.

7. The variable cycle internal combustion engine according to claim 6, wherein said first cam is a two-cycle action cam and said second cam is a four-cycle action cam.

8. The variable cycle internal combustion engine according to claim 6, wherein said first cam is a two-cycle action cam and said second cam is a six-cycle action cam.

9. The variable cycle internal combustion engine according to claim 6, wherein said cam change mechanism includes:

a driving rocker arm defining a first guide hole and being contactable with said first cam;

a free rocker arm defining a second guide hole and being contactable with said second cam;

a piston slidably received in said first guide hole, said piston being movable toward said second guide hole by means of hydraulic pressure so as to connect said free rocker arm with said driving rocker arm; and a spring urging said piston toward said first guide hole against the hydraulic pressure, wherein, when said free rocker arm is connected with said driving rocker arm by said piston, said intake valve and exhaust valve are opened in accordance with the profile of said second cam, and when said free rocker arm is disconnected from said driving rocker arm, said intake valve and exhaust valve are opened in accordance with the profile of said first cam.

* * * * *